US007707939B2

(12) United States Patent
Brent et al.

(10) Patent No.: US 7,707,939 B2
(45) Date of Patent: May 4, 2010

(54) METHOD OF BLASTING

(75) Inventors: Geoffrey Frederick Brent, Valentine (AU); Alan Minchinton, Eleebana (AU); Michael John Noy, Cardiff South (AU)

(73) Assignee: Orica Explosives Technology Pty Ltd, Melbourne (AU)

( * ) Notice: Subject to any disclaimer, the term of this patent is extended or adjusted under 35 U.S.C. 154(b) by 556 days.

(21) Appl. No.: 11/570,637

(22) PCT Filed: Jun. 21, 2005

(86) PCT No.: PCT/AU2005/000890

§ 371 (c)(1),
(2), (4) Date: Jan. 29, 2007

(87) PCT Pub. No.: WO2005/124272

PCT Pub. Date: Dec. 29, 2005

(65) Prior Publication Data

US 2008/0245254 A1 Oct. 9, 2008

Related U.S. Application Data

(60) Provisional application No. 60/581,847, filed on Jun. 22, 2004.

(51) Int. Cl.
*F42D 1/06* (2006.01)
*F42D 3/04* (2006.01)
*F42D 1/055* (2006.01)

(52) U.S. Cl. ..... 102/312; 102/313; 299/13

(58) Field of Classification Search ..... 102/301, 102/311, 312, 313; 299/10, 13, 18; 175/2, 175/4.55, 57

See application file for complete search history.

(56) References Cited

U.S. PATENT DOCUMENTS 3,295,445 A 1/1967 Ball et al.

(Continued)

FOREIGN PATENT DOCUMENTS

AU 200028890 10/2000

(Continued)

OTHER PUBLICATIONS

Blaster's Handbook—A Manual Describing Explosives and Practical Methods of Use, Sales Development Section of the Explosives Department E.I. du Pont de Nemours & Co. (Inc.), Wilmington, DE, copyright 1942, pp. 180-184, 336-338, 429, 430 and 437.

(Continued)

*Primary Examiner*—James S Bergin
(74) *Attorney, Agent, or Firm*—Fish & Richardson P.C.

(57) ABSTRACT

Methods of blasting rock are disclosed and claimed in which blast holes are arranged in group of 2 to 7 blast holes. Within each of the groups, adjacent columns of explosive material (12) are actuated within 5 ms of one another Initiation of blasting between the respective groups occurs at least 8 ms after completion of initiation of an adjacent group. Initiation devices (13, 24) may be located at the lower end, upper end or both ends of the respective blast holes, depending on the stress field that is intended to be generated within the rock. As a result, environmental stresses such as ground vibrations are reduced, and the efficiency of rock fragmentation are increased.

33 Claims, 11 Drawing Sheets

U.S. PATENT DOCUMENTS

| | | | | | |
|---|---|---|---|---|---|
| 3,903,799 | A * | 9/1975 | Walker | 102/311 |
| 3,987,732 | A | 10/1976 | Spraggs et al. | |
| 5,377,592 | A * | 1/1995 | Rode et al. | 102/210 |
| 5,388,521 | A * | 2/1995 | Coursen | 102/311 |
| 5,520,114 | A | 5/1996 | Guimard et al. | |
| 5,539,636 | A * | 7/1996 | Marsh et al. | 702/79 |
| 5,614,693 | A | 3/1997 | Welch | |
| 6,220,167 | B1 * | 4/2001 | Yamamoto et al. | 102/312 |
| 6,460,462 | B1 | 10/2002 | Rosenstock | |
| 6,532,874 | B2 | 3/2003 | Yoon | |
| 6,941,870 | B2 * | 9/2005 | McClure et al. | 102/311 |
| 7,406,918 | B2 * | 8/2008 | Brent et al. | 102/312 |

FOREIGN PATENT DOCUMENTS

| | | | |
|---|---|---|---|
| CA | 2302166 | | 1/2000 |
| WO | WO 02/057707 | | 7/2002 |
| WO | WO 2005124272 | A1 * | 12/2005 |

OTHER PUBLICATIONS

D.P. Blair, "Statistical models for ground vibration and airblast", Fragblast-Int. J. Blasting and Fragmentation 3:335-364 (1999).

Frank Chiappetta, "Precision detonators and their applications in improving fragmentation, reducing ground vibrations, and increasing reliability—a look into the near future" Blasting Analysis International conference, Nashville, TN (Jun. 1992).

* cited by examiner

METHOD OF BLASTING

FIELD OF THE INVENTION

The present invention relates to methods of blasting rock. In particular, the invention relates to improvements in the configuration and timing of a blasting event to improve the efficiency of rock fragmentation and reduce environmental impact.

BACKGROUND TO THE INVENTION

Blasting operations often involve initiation of a plurality of explosive charges. Typically, blastholes are drilled into the rock to be blasted. The blastholes are at least partially filled with explosive material, and one or more initiation means are associated with each explosive charge. Command signals generated by a central command station are transmitted to one or more blasting machines, each in signal communication with one or more initiation means in blastholes at the blast site. The command signals can arm, disarm and fire the initiation means as appropriate.

The quality of the blasting event can be measured by the degree and efficiency of rock fragmentation. Many factors influence the efficiency of blasting. Some of the most important factors include the arrangement of the explosive charges at the blast site, and the relative timing of initiation of the explosive charges. Such factors influence the co-operation of stress fields propagating from initiation of each explosive charge in each blasthole. Numerous blasting methods are known in the art that specify the arrangement and/or relative timing of explosive charges, which attempt to optimise rock fragmentation without the need for excessive quantities of explosive material.

In one example, U.S. Pat. No. 3,295,445 issued Jan. 3, 1967, discloses a method of blasting in which a multiplicity of charges are separated into groups of charges. The charges in each group are detonated at substantially the same time, and the groups are detonated sequentially by means of delay detonators in such a manner that groups of charges not yet fired are initiated before proximate charges in adjacent groups are fired.

In another example, U.S. Pat. No. 3,903,799 issued Sep. 5, 1975 provides for a method of blasting which allows greater amounts of explosives to be detonated at one shooting than was previously possible while at the same time holding the maximum vibration produced at or below levels produced by a single detonation. A plurality of charges are arranged in spaced apart rows with the detonations within a row being detonated with time delays of 10 ms or more and with the detonations between successive rows being detonated with time delays of from 25 to 150 milliseconds.

In another example, a paper entitled "Precision detonators and their applications in improving fragmentation, reducing ground vibrations, and increasing reliability—a look into the near future" by R. Frank Chiappetta, presented at the Blasting Analysis International conference, Nashville, Tenn. (June 1992) discloses numerous methods of blasting and is incorporated herein by reference. The disclosure includes discussion of the use of explosive columns of material, wherein the columns are embedded in predrilled blastholes. As is typical in the art, a primer triggers actuation of the column of material at one end, causing the material to produce a detonation head, which burns along the column away from the primer. Shockwaves are propagated from the detonation head in such a manner that the shockwaves exert their greatest stress perpendicular to the primary shockwave. The reference discloses the use of primers positioned at opposite ends of columns of explosive materials in adjacent blastholes. In this way, interference of opposing shockwaves propagated from the adjacent blastholes can cause rotational motion giving rise to increased tossing and shearing of the rock located between the blastholes.

In another example, U.S. Pat. No. 5,388,521 issued Feb. 14, 1995, discloses a method of blasting involving one or more arrays of elongate, chemical explosive charges so as to produce relatively low levels of ground vibration. The orientation and velocity of propagation of vibration are such that, at a selected outlying location, the onset of vibration from explosion of the first negligibly small increment of the charge arrives a finite time before that from explosion of the last negligibly small increment. The charges of each array are fired in accurately timed sequence, with the times between initiations chosen so that, at the outlying location, the onset of vibration from explosion of the last small increment of charge, except the last charge, arrives a negligibly small increment of time before the onset of vibration from explosion of the first small increment of the succeeding charge. All arrays are designed to give equal times between onsets of vibration from the first and last charge increments to explode.

In another example, International Patent Publication WO02/057707 published Jul. 25, 2002, discloses methods of blasting involving precision timing of electronic detonators. The methods make use of precision timing to control the generation and formation of the rock pile resulting from a blasting event. The timing and arrangement of blastholes at the blast site can increase or decrease rockpile displacement as desired.

In another example, U.S. Pat. No. 6,460,462 issued Oct. 8, 2002, discloses a method of blasting rock or similar materials in a surface and underground mining operations in which neighbouring bore holes are charged with explosives and primed with detonators. The detonators are programmed with respective delay intervals according to the firing pattern and the mineral/geological environment and the resulting seismic velocities.

Although significant advances have been made in blasting methods over recent years, there remains a continuing need to develop improved methods of blasting that offer efficient rock fragmentation without the need for excessive quantities of explosive materials. Moreover, there remains a continuing need to develop methods of blasting in which the rock is properly fragmented without excessive impact upon the surrounding environment, for example through excessive ground vibrations.

SUMMARY OF THE INVENTION

It is an object of the present invention, at least in preferred embodiments, to provide a method of blasting rock that reduces the environmental impact of the blasting event.

It is another object of the present invention, at least in preferred embodiments, to provide a method of blasting rock that results in improved rock fragmentation.

The inventors have developed a method for blasting rock that significantly improves the quality and efficiency of a blasting event. These improvements have in part been realised from detailed research of the interference of subterranean stressfields propagated following actuation of groups of explosive charges in pre-drilled blastholes. The timing of initiation of the explosive charges, the grouping of the explosive charges, and the resulting patterns of stressfields interaction have profound effects upon the blasting event and the efficiency of rock fragmentation. In this way, the invention provides dramatic improvements to the methods of blasting of the prior art.

Electronic detonators are preferably used with the method of the present invention because of their capacity for accurate timing with delay differences as low as 1 millisecond. However, the methods are not limited in this regard. In fact, any type of initiator system may be used in accordance with the invention, including traditional non-electric, electric, and electronic detonator systems.

According to the present invention there is provided a method of blasting a section of rock to cause fragmentation of the rock without excessive ground vibrations, the method comprising the steps of:

providing two or more groups of blastholes in the rock, each group comprising from 2 to 7 blastholes each of which is adjacent to another of said blastholes within the group;

loading each blasthole with an explosive charge;

providing blast initiation means associated with each explosive charge; and inducing timed actuation of each explosive charge via the associated blast initiation means to propagate stressfields from each blasthole;

wherein the explosive charges in adjacent blastholes within any group of blastholes are actuated within 5 ms of one another, whereby the stressfields from the blastholes within each group combine prior to dissipation to enhance fragmentation of the rock, and wherein a delay of at least 8 ms occurs between completion of actuation of explosive charges in any group of blastholes and commencement of actuation of explosive charges in any adjacent group of blastholes, whereby the combined stressfields that propagate from blastholes within any group of blastholes at least substantially dissipate prior to actuation of explosive charges within blastholes of any adjacent group of blastholes.

By the present invention, it is possible in at least some embodiments to reduce the quantity of explosive material required for the blasting event as well as to reduce the environmental impact of the blast.

The determination of the number of holes, and as a result the total explosive charge to be used in any group of holes, has been achieved by detailed analysis of and research into blast vibration control techniques. The control of excessive rock vibration from blasting may be achieved through a number of means. Conventional charge weight scaling laws may be derived for the particular blasting site and applied to determine the maximum charge weight permissible to control vibration at the points of concern in the vicinity of the blast. Preferably, more sophisticated approaches can be used. A particularly effective approach is the use of statistical vibration models based on waveform superposition (for example, Blair, D. P., 1999. Statistical models for ground vibration and airblast, *FRAGBLAST-Int. J. Blasting and Fragmentation* 3:335-364 ("Blair 1999")). Blast waveforms from typical blastholes may be obtained experimentally for the blasting site and applied to the region of concern. The statistical vibration model may then be used to determine the appropriate charge weights to be used within each group within the blast field.

Charge weights and the number of holes per group or per array within groups (as described hereinafter) may be varied across the blast field as vibration requirements change over the blast field. Thus, different blasting techniques within the scope of the invention may be used across a single blast field.

The way in which the present invention is implemented across a blast field may be consistent over the various groups of blastholes in the blast field. Alternatively, the way in which the invention is implemented may vary between groups of blastholes across the blast field, as may be required. This may be useful where the material (rock) being blasted varies across the blast field and/or where it is desired to provide different effects (or blast outcomes) across the blast field.

In another embodiment, a blast in accordance with the invention may be combined with a blast of one or more sections of rock in the blast field that are not in accordance with the invention. This may be particularly advantageous adjacent the edges of the blast field where less fragmentation of the rock may be desired. In this embodiment it will be appreciated that at least two groups of blastholes in the rock are blasted in accordance with the method of the present invention.

The inventors' detailed research into the use of such vibration control approaches has established that the most practical range of blastholes per group is between 2 and 7. Similarly, 8 ms has been found to be the minimum practical time delay between groups of holes that are initiated as described by this invention in order to achieve some control of blast vibration. Note that the actual initiation delays both within and between groups of holes may vary across the blast field as vibration requirements change over the blast field. Models such as that of Blair (1999) can be used to set these delay times to meet the specific blasting site requirements.

Preferably each group of blastholes comprises from 3 to 5 blastholes. In many blasting events 3 blastholes per group will be found to be satisfactory, but the particular number may vary as described. The group of blastholes may extend linearly along a single row or across rows, or they may be in adjacent rows with two or more blastholes in at least one of the rows.

In the following embodiments the various blast designs are described with reference to at least one group of the two or more groups of blastholes referred to in the general definition of the present invention. As mentioned above, the blast design may be uniform across an entire blast field in which case each group of blastholes of the two or more groups of blastholes will have the same blast design. Alternatively, without departing from the spirit of the present invention, the blast design may vary across the blast field as between different groups of blastholes of the two or more groups of blastholes blasted in accordance with the present invention. In this case the blast design of one or more groups of blastholes may be different from one or more other groups of blastholes provided at other areas of the blast field.

It is also possible that a section of the blast field may be blasted using conventional blasting techniques. In this case however the blast field will still include at least two groups of blastholes that are blasted in accordance with the method of the present invention. In this case the at least two groups of blastholes may be the same or different in blast design, as described above.

The delay between completion of actuation of explosive charges in any group of blastholes and commencement of actuation of explosive charges in any adjacent group of blastholes may be longer than 8 ms, for example 25 ms or more.

The explosive charges in adjacent blastholes within any group of blastholes may be actuated at different times within 5 ms of each other or at substantially the same time. By "substantially the same time" as used throughout this specification is meant within 1 ms.

Preferably, the explosive charges in adjacent blastholes within any group of blastholes are actuated within about 1 to 3 ms of one another.

In one embodiment the explosive charges in all blastholes within any group of blastholes are actuated within 5 ms of one another, preferably within about 1 to 3 ms of one another.

A variety of different arrangements of explosive charge may be used in blastholes across a blast field. Commonly the explosive charge comprises a column of explosive material, and different embodiments of methods of blasting in accordance with the invention will be described hereinafter using columns of blasting material.

In one embodiment, each blasthole in at least one group of the two or more groups of blastholes is loaded with an explosive charge that comprises a column of explosive material and that is associated with an initiation means comprising a single initiation device positioned in the column to produce a detonation head within the column such that the detonation head burns away from the initiation device, thereby to propagate the stressfields from the column.

In this embodiment, the at least one group of blastholes may comprise two or more arrays of one or more blastholes, the explosive material in different arrays within the same group being actuated at different times but the explosive material in two or more blastholes of any selected array being actuated at substantially the same time, with each blasthole from any selected array being adjacent to a blasthole of another array in the group. Thus, if two arrays of blastholes are provided in a group, these will alternate in a group of three or more blastholes.

In this embodiment, the single initiation devices may be positioned at or adjacent (usually within 1 m of) the same or different ends of the columns in the different arrays. Thus, in one arrangement the initiation devices are positioned at or adjacent the same end of the columns of explosive material in the at least one group of blastholes, thereby to stagger progression of the detonation heads within at least two adjacent blastholes of the same group of blastholes. The initiation devices may be positioned in this arrangement adjacent the collar end of the columns, but preferably they are positioned at or adjacent the toe end of the columns of explosive material in the at least one group of blastholes.

In another arrangement, the at least one group of blastholes comprises two or more arrays of one or more blastholes, in at least one of the arrays the initiation device being positioned at a first end of each column for unidirectional actuation of each column in the at least one array in a first direction and in at least one other of the arrays the initiation device being located at a second end of each column in the at least one other array for unidirectional actuation thereof in a second direction, with each blasthole from any selected array being adjacent to a blasthole of any other array in the group.

In a variation of this embodiment, the single initiation device in each column of the at least one group of blastholes may be positioned remote from the ends of the column. The initiation devices may be positioned about midway between the ends of the columns, but in one arrangement the initiation devices in adjacent columns of the at least one group of blastholes are offset relative to each other. This may stagger progression of the detonation heads within adjacent blastholes of the group.

In another embodiment, each blasthole in at least one group of the two or more groups of blastholes is loaded with an explosive charge that comprises a column of explosive material and that is associated with an initiation means comprising a first and a second initiation device positioned at or adjacent opposite ends of the column to produce two detonation heads within the column such that the detonation heads burn away from each initiation device towards each other, thereby to propagate opposed stressfields from the column in the at least one group of blastholes that combine both with one another and with stressfields propagating from at least one adjacent blasthole in said group to enhance said fragmentation of the rock.

In this embodiment, advantageously in one arrangement the at least one group of blastholes comprises two or more arrays of one or more blastholes, the columns of explosive material in blastholes of different arrays within the same group being actuated by the first initiation devices at different times and by the second initiation devices at different times but the columns of explosive material in two or more blastholes of any selected array being actuated by the first initiation devices thereof at substantially the same time and by the second initiation devices thereof at substantially the same time, and wherein each blasthole from any selected array is adjacent to a blasthole in any other array in the group thereby to stagger progressive bidirectional actuation of said columns of explosive material in the blastholes within the at least one group of blastholes.

In this arrangement the columns of explosive material in the blasthole or each blasthole of any selected array within the at least one group of blastholes is actuated by the first and second initiating devices at substantially the same time or at different times. If at different times, preferably the columns of explosive material in the blasthole or in each blasthole or each blasthole within the array is actuated by the second initiation device at a time when the detonation head from the actuation of the column by the first initiation device has travelled between about 51 and 95%, preferably between about 60 and 90% more preferably between about 75 and 85%, for example about 80% of the length of the column towards the second initiation device.

In a possible further embodiment, each blasthole in at least one group of the two or more groups of blastholes is loaded with an explosive charge that comprises a column of explosive material and the at least one group of blastholes comprises two or more arrays of one or more blastholes, wherein in at least one of the arrays the initiation means comprises a first and a second initiation device positioned at or adjacent opposite ends of each column of the array to produce two detonation heads within the column such that the detonation heads burn away from each initiation device towards each other, thereby to propagate opposed stressfields from the column that combine with one another, wherein in at least one other of the arrays the initiation means comprises a single initiation device positioned remote from the opposite ends of each column of the array to produce a single detonation head within the column that burns in opposite directions away from the initiation device, and wherein each blasthole from any selected array is adjacent to a blasthole in any other array in the at least one group of blastholes thereby to propagate stressfields from adjacent blastholes within the at least one group of blastholes that combine to enhance fracture. In this embodiment, preferably the single initiation device in each column of said at least one other array is disposed about midway along the column. The explosive material in each column of said at least one array is actuated by the first and second initiation devices at substantially the same time or at different times, for example as described above.

In yet another embodiment using first and second initiation devices in each column of explosive material within the at least one group of blastholes, the group need not be arranged in arrays. Thus, in this embodiment, the columns of explosive material in all of the blastholes within the at least one group of blastholes are actuated by the first initiation devices at different times to each other and by the second initiation devices at different times to each other.

In this embodiment each column of explosive material may be actuated by the first initiation device at substantially the same time as it is actuated by the second initiation device or at different times, for example as described above.

In another aspect of the present invention there is provided a blasting system for conducting the method according to the invention, the blasting system comprising:

a plurality of explosive charges, each charge positioned in a corresponding blasthole;

initiation means associated with each explosive charge for actuation thereof in response to appropriate signals;

timing means to time actuation of each explosive charge in accordance with the requirements of the method;

at least one blasting machine to provide control signals to each initiation means in the system.

BRIEF DESCRIPTION OF THE DRAWINGS

Embodiments of methods of blasting in accordance with the invention will now be described, by way of example only, with reference to the accompanying drawings, in which.

DEFINITIONS

'Actuate'—refers to the initiation, ignition, or triggering of explosive materials, typically by way of a primer, detonator or other device capable of receiving an external signal and converting the signal to cause detonation of the explosive material.

'Array'—refers to a sub-group of blastholes within a group of blastholes, that are often fairly evenly spaced and distributed throughout the group. Typically, where more than one array of blastholes is present, the two arrays are regularly interspersed or intermingled such that most if not all of the blastholes from an array are adjacent or close to a blasthole from another array.

'Bidirectional actuation'—refers to the result of initiating a column of explosive material from both ends via appropriate initiation means. The initiation means may actuate each end simultaneously such that the resulting detonation heads converge at a convergent zone approximately at the centre of the length of the column. Alternatively, a delay may occur between the initiation of each end of the column, resulting in the convergence of the detonation heads in a region other than the central region of the column. Typically, bidirectional actuation of a column of explosive material gives rise to two distinct conical radiations of waves and stressfields as shown in FIG. 1*c*.

'Blasthole'—generally refers to an elongate hole or recess, preferably cylindrical in form, drilled into a section of rock for loading, for example, explosive materials and initiation primers for actuating the explosive materials. However, blastholes may take any shape or form that is amenable to receiving explosive materials.

Figure 1A:
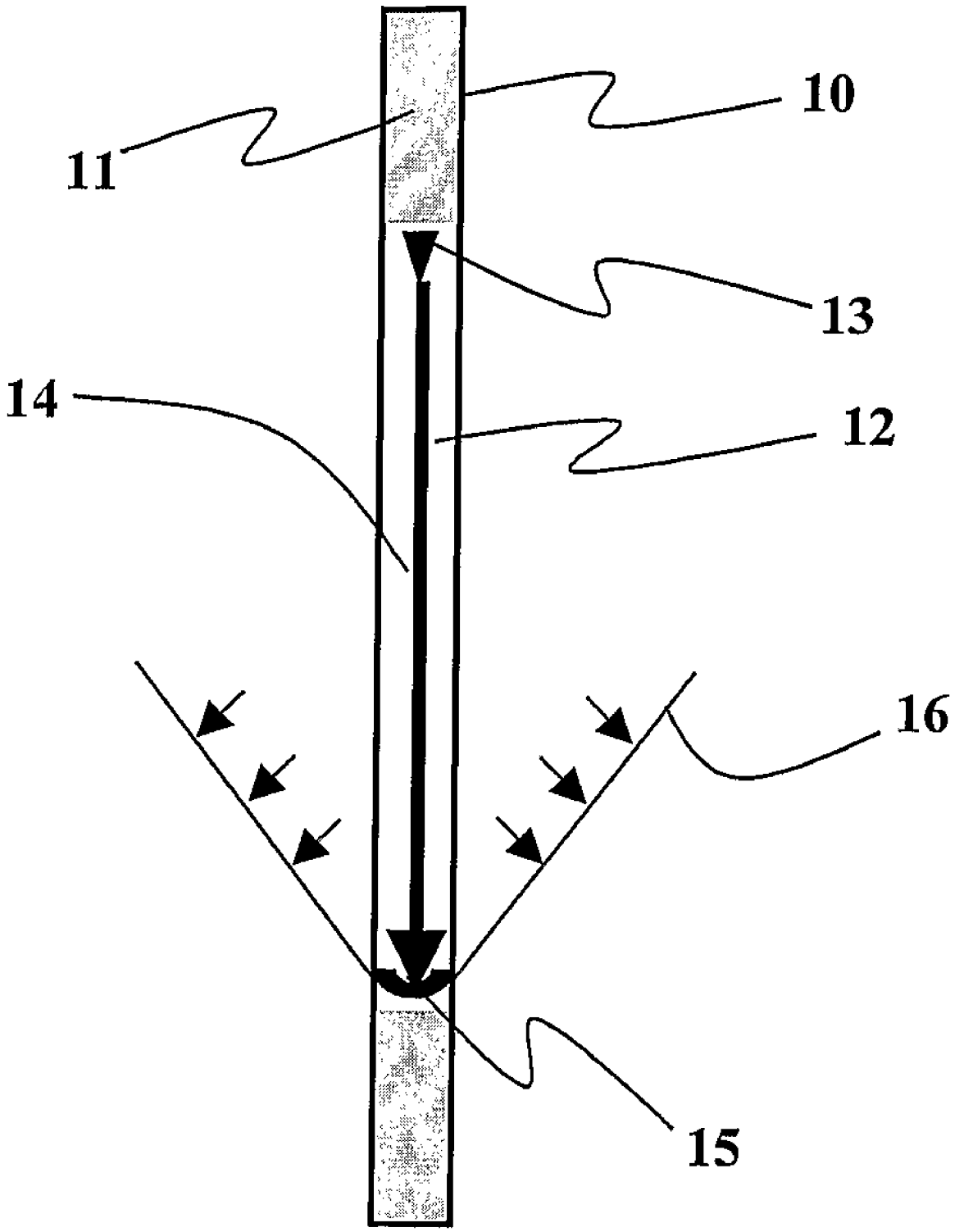
FIG. 1*a* schematically illustrates unidirectional actuation of a column of explosive material in a blasthole.

'Conical radiation'—refers to the general shape of the waves and stressfields propagated as a result of the progressive unidirectional deflagration of a column of explosive material, as shown for example in FIG. 1*a*. This expression further encompasses patterns that are not precisely conical, but vary as a result of variations in the system such as the thickness of the explosive materials, the speed of detonation head progression, or reliability of the detonation process.

'Detonation head'—refers to a moving front of deflagrating material following initiation of a column of explosive material in a blasthole. The moving front burns through the explosive material, leaving behind combusted material that is no longer amenable to combustion. Stressfields propagating from the detonation head result in rock fragmentation and disruption.

'Ground vibrations'—refer to unwanted vibrations in and around a blast site that sometimes do not contribute to rock fragmentation or fracture. Such ground vibrations can lead to unwanted disruption of rock or subterranean structures and strata giving rise to safety concerns. Excessive ground vibrations may be caused, for example, by positive interference of vibration waves propagated from explosive charges in multiple blastholes initiated at substantially the same time, or at a similar time.

'Group'—refers to a group of blastholes, wherein the blastholes within a single group are positioned such that the timing of explosive charges within the blastholes gives rise to stressfields that combine between the blastholes. Preferably, when explosive charges within the blastholes of a single group of blastholes are actuated the delay between actuation of explosive charges in any two adjacent blastholes is less than 5 ms. Preferably, the actuation of explosive charges in the blastholes of separate groups is separated by at least 8 ms.

'Interference'—refers to the interaction of stressfields originating from different sources (e.g. from the same blasthole or from different blastholes) to give rise to improved disruption, fragmentation or fracture of rock between the blastholes. For example, stressfields may cooperate to give rise to shear forces to help further enhance rock breakage and disruption.

'Stressfields'—includes stress and vibration waves propagated typically in most if not all directions by the actuation of an explosive charge in a blasthole. Preferably, the propagation originates from a detonation head progressing along a column of explosive material positioned in the blasthole. Often, such a radiation will take the form of a conical radiation. However, the stressfields are not limited to those having a conical formation. Rather, they may take any form such as a simple spherical radiation from a stationary point source. Moreover, such a radiation may result from an extended period of propagation or a very short period of propagation.

'Regularly interspersed'—refers to the intermingling of blastholes, and their components for example between one array and another array. Typically, the blastholes of two separate arrays are interspersed in a regular fashion, such that most if not all of the blastholes from one array separate those of the other array. For example, in terms of a single row of blastholes, regularly interspersed would include an arrangement where most if not all of the blastholes from one array are alternated with those from another array.

'Rock' includes all types of waste and host rock as well as recoverable mineral deposits such as shale, coal and iron ore.

'Staggered'—refers to stressfields, detonation heads, or convergence zones that are offset relative to one another. Typically, such features are not staggered if they all fall approximately into one plane. Actuation of columns of explosive material in adjacent blastholes can be timed to ensure that resulting stressfields, detonation heads, or convergence zones are staggered, as shown for example in FIGS. 4*c* and 5.

'Unidirectional actuation'—refers to the result of initiating a column of explosive material from a single end to cause a detonation head to burn through the column of explosive material from one end to the other. Unidirectional actuation of a column of explosive material generally gives rise to a single conical radiation of stressfields as shown in FIG. 1*a*.

DETAILED DESCRIPTION OF THE PREFERRED EMBODIMENTS

Numerous methods of blasting rock are known in the art. Generally, modern methods rely upon the use of a plurality of explosive charges distributed throughout the rock, with delay times to achieve a desired blasting pattern. The arrangement of the charges and the timing of the blasting event can significantly affect the quality of the blast and the efficiency of rock fragmentation.

Typically, a section of rock is prepared for blasting by drilling a series of blastholes, into which are packed various components including explosive materials and initiation devices (e.g. detonators). The spatial distribution of the blastholes can vary according to the type of rock, and the desired blasting results. Blastholes may be arranged into rows or groups, and spaced according to various parameters. In accordance with the present invention blastholes may also be designated into arrays of blastholes, wherein each array of blastholes may be regularly interspersed within blastholes of another array. For example, a row of blastholes may comprise two different arrays of blastholes, with every other blasthole belonging to a first array, and the remaining blastholes belonging to a second array. Any given row or group of blastholes may comprise two or more arrays, such that at least two adjacent blastholes belong to different arrays. Alternative functions may be assigned to different arrays of blastholes, for example to delay actuation of explosive charges in different arrays and to achieve alternative blasting patterns.

The methods of blasting of the present invention rely in part upon the accuracy of modern blasting systems. Modern electronic detonators can be programmed with delay times with an accuracy of 1 millisecond or less. For this reason, the use of electronic detonators is particularly preferred in accordance with the methods of the invention. However, the methods are not limited to electronic detonators, and can be applied to any blasting system that affords high levels of accuracy for timing actuation of explosive charges.

The methods of the present invention, at least in preferred embodiments, achieve following advantages over the methods of the prior art:

1. Stressfields propagated from adjacent blastholes can cooperate to improve the efficiency of rock fragmentation or fracture, for example by increased shear forces in the rock;
2. Unwanted environmental stresses, such as excessive ground vibrations, are reduced;

The present invention relates to discoveries by the inventors, which in combination provide optimal results to achieve the advantages outlined above. One discovery relates to the organisation of the explosive charges and timing of actuation of the explosive charges at the blast site. For example, the inventors have discovered that the environmental impact of a blasting event can be significantly reduced if the blastholes are organised into groups, wherein explosive charges in adjacent blastholes are actuated preferably at a slightly different time (generally within 5 ms), and explosive charges in separate groups of blastholes are actuated with a delay of generally at least 8 ms between the groups. This organisation can give rise to reduced environmental stresses at the blasting site including, but not limited to, a reduction in excessive ground vibrations, without foregoing stressfield cooperation between blastholes that increases the efficiency of rock disruption (see below).

Safety considerations at the blast site are paramount, and it is most desirable to maintain ground vibrations to a minimum. Ground vibrations may be caused by unwanted cooperative interference of stressfields originating from several blastholes. By actuating all explosive charges in a large blast site at substantially the same time, ground vibrations can increase resulting in unwanted disruption of rock and strata surrounding the blast site. The inventors have discovered that by arranging the blastholes into groups, actuating explosive charges in each group preferably at slightly different times (i.e. within 5 ms of one another in the case of adjacent charges), and by separating the actuation of each group by at least 8 ms, very desirable results can be achieved by way of significant reductions in unwanted ground vibrations.

The explosive charges may typically comprise a column of explosive material packed into each blasthole, actuated either in a unidirectional fashion from one end of the column, or in a bidirectional fashion from both ends of the column. In any event, actuation of a single end of any column by an initiating primer will give rise to the formation of a detonation head that burns through the column of explosive material in a direction away from the initiating primer. In the case of a bidirectional initiation event, the detonation heads will converge in a convergent zone, and the timing of actuation of each end of a given column will determine the location of the convergent zone along the column's length.

Importantly, significant advantages can be gained by inducing unidirectional or bidirectional initiation of adjacent columns of explosive material in adjacent blastholes at different times within 5 ms of one another. Interference between stressfields formed within the same blasthole, and between stressfields of adjacent blastholes, can help to compound shear forces between the blastholes, further assisting rock fragmentation and fracture.

In particularly preferred embodiments, the pattern of actuation of the explosive charges may be managed more carefully by organising the blastholes (and their explosive charges) into defined arrays, each having predetermined timing and delay parameters. For example, explosive charges in a first array of a group of blastholes may be programmed for bidirectional initiation at time zero, whereas explosive charges in a second array in the same group of blastholes may be programmed for bi-directional initiation at time zero plus 1-5 ms. In this way, the convergent zones of each column would all be approximately in the central portions of each column, but the completion of column actuation would vary in most adjacent columns. As an alternative, bidirectional initiation in different arrays may be timed to produce staggered convergent zones, such that the convergent zones of adjacent columns are rarely in the same position of the column. Without wishing to be bound by theory, this pattern of column actuation is thought to present particular advantages, including excellent rock shearing and disruption, resulting from the varying interference of stressfields between adjacent blastholes in any given group.

For the purposes of further clarification of the invention, specific embodiments of he invention will now be described with reference to the appended drawings, which are in no way intended to be limiting. For simplicity, the drawings illustrate blastholes and column actuation in two dimensions, wherein simple rows of blastholes are illustrated. However, it will be understood by a person of skill in the art that the principles illustrated in the drawings are not limited to two dimensional arrangements of blastholes. Rather, the invention encompasses methods and systems of blasting involving arrays of blastholes organised in three dimensions at the blast site.

Turning first to FIG. 1*a*, there is illustrated a typical configuration comprising a blasthole, initiation means and explosive material for use in accordance with the methods of the present invention. Such blasthole configurations are well known in the prior art. The blasthole 10 may be prepared in the rock by drilling. Note that the rock surrounding the blasthole is not shown in FIG. 1*a*, or any other Figures of the present application for the sake of simplicity and in the interests of clarity. The blasthole 10 includes packing (stemming) material 11 between which is positioned over a column of explosive material 12. At one end of the explosive material 12 is located means for initiation 13 which may comprise any suitable form of initiation device. The initiation device is capable of initiating actuation of the explosive material in such a manner that a 'wave' of actuation 14 travels in a unidirectional fashion along the column via an actuation zone 15 otherwise known as a detonation head. The detonation head 15 (as well as other material behind the detonation head that is still undergoing a degree of deflagration) is a moving origin of explosive energy that generates stressfields 16. Typically, the movement of the detonation head, and the nature of the column results in the production of a substantially conical radiation of stressfields 16 behind the detonation head (the three dimensional shape of the conical radiation is not illustrated in FIG. 1*a*).

Figure 1B:
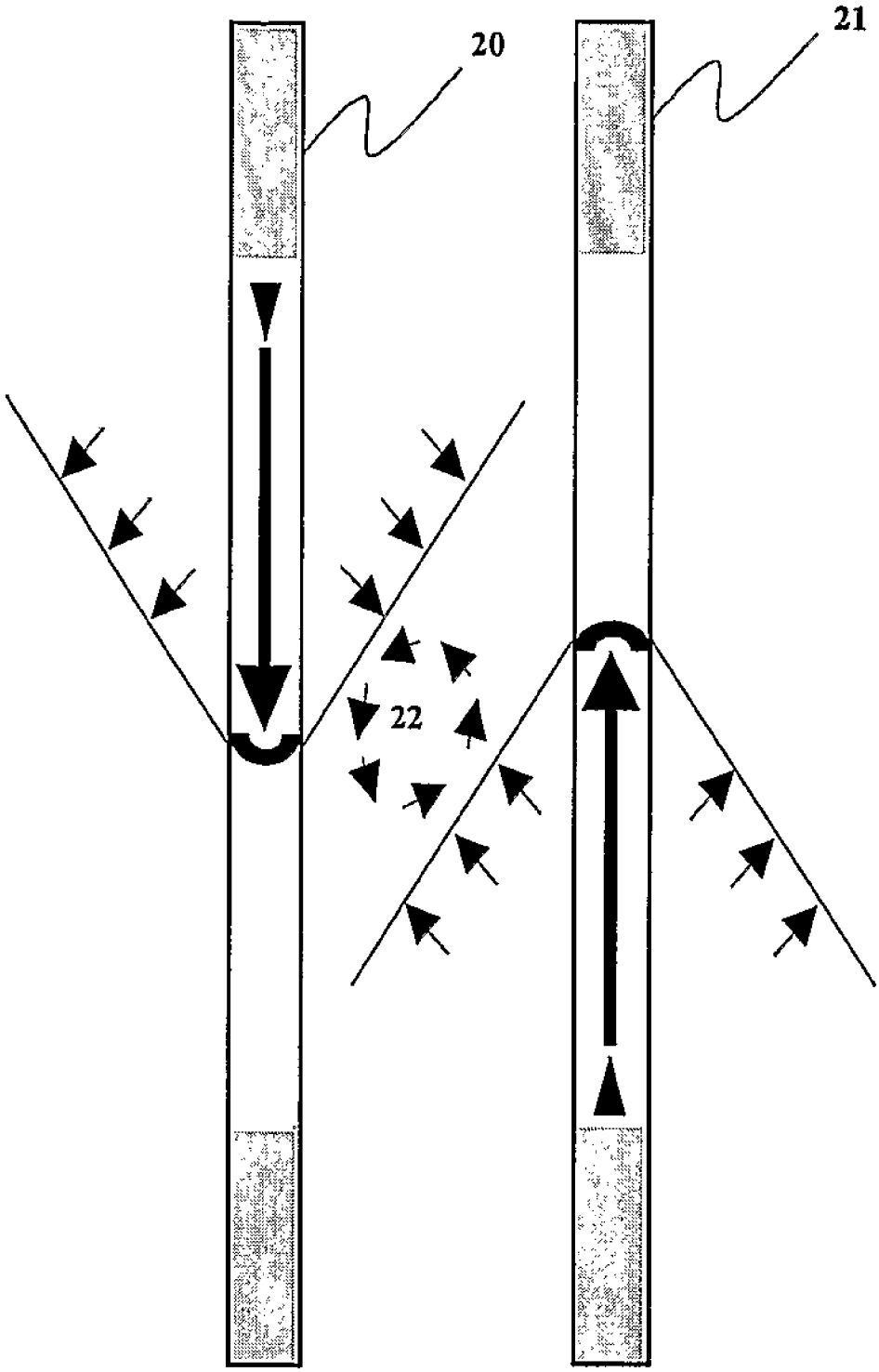
FIG. 1*b* schematically illustrates opposing unidirectional actuation of two columns of explosive material in adjacent blastholes.
Figure 1C:
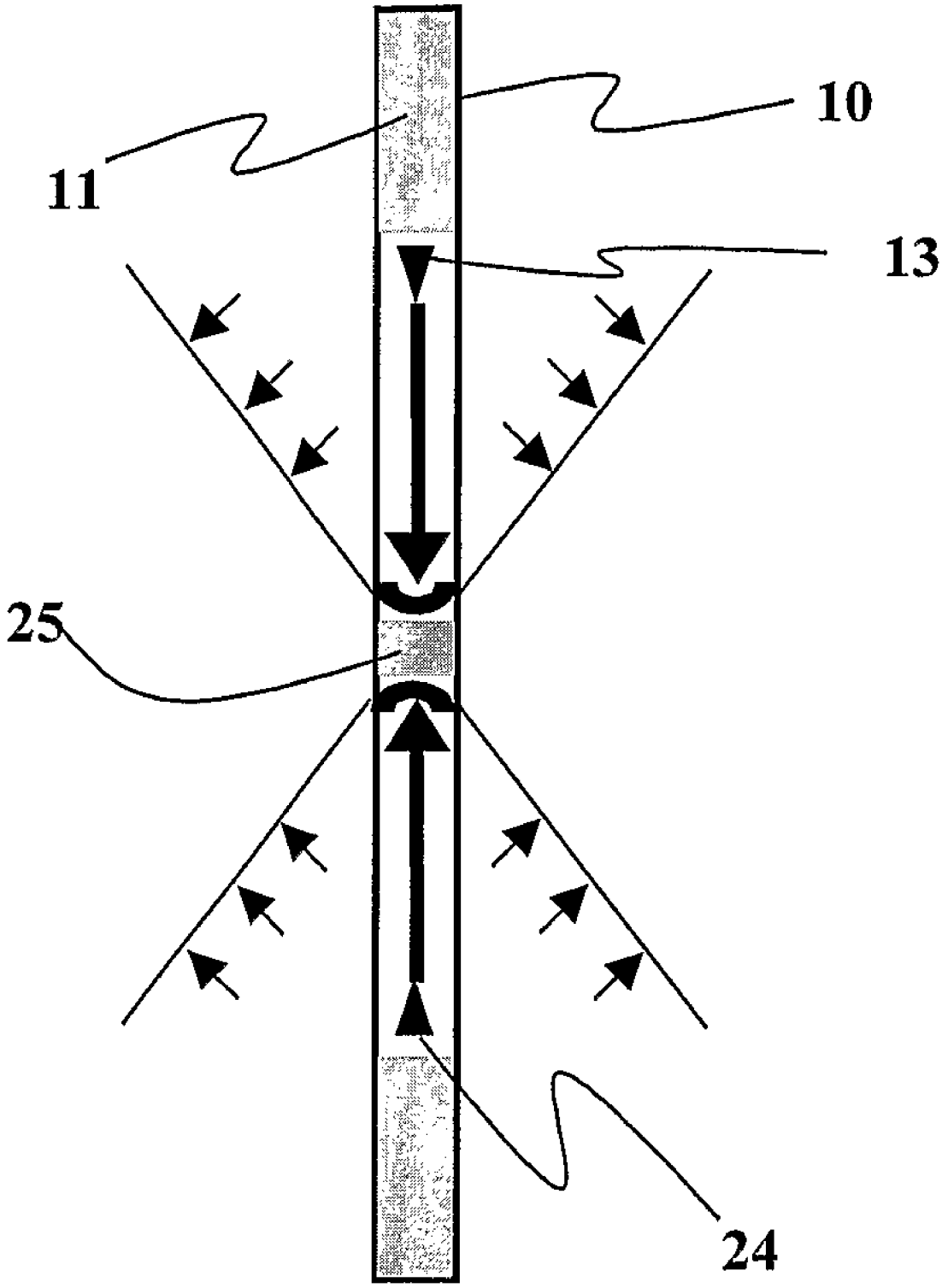
FIG. 1*c* schematically illustrates bidirectional actuation of a column of explosive material in a blasthole.

It is also known in the art that adjacent blastholes can be set up at a blast site in the manner shown in FIG. 1*b*. The blastholes 20 and 21 illustrated have been set up such that the unidirectional progression of the detonation heads are moving in opposite directions as shown. This can result in interference of stressfields in a region 22 between the blastholes in question. Typically the net affect of this interference can include a degree of rotational motion and forces in zone 22 in FIG. 1*b*, effectively to increase the tossing and shearing of the rock between the blastholes, thereby optimising rock fragmentation and fracture.

As shown in FIG. 1*c*, the prior art also teaches the use of two initiation devices 13, 24 at each end of a column of explosive material. Actuation of the initiation devices at each end of the column 12 shown in FIG. 1*c* results in bidirectional actuation of the column 12, giving rise to two distinct detonation heads moving away from each end of the column towards a central portion of the column. The detonation heads each generate a separate conical radiation of stressfields that propagate from the blasthole. Moreover, the detonation heads converge at a convergence zone 25 in a central portion of the column.

One embodiment of the invention will be described with reference to FIG. 2. The Figure illustrates a plurality of blastholes 10, each comprising a column of explosive material 12 and two initiation devices 13, 24 at each end for bidirectional actuation of the column 12. However, this is a preferred feature, and the invention includes methods in accordance with FIG. 2 wherein some or all of the columns 12 are associated with only one initiation device for unidirectional actuation thereof. For the sake of simplicity the blastholes are illustrated in ordered rows. The dotted lines separating each row, and subdividing the blastholes in each row, indicate that the blastholes are separated into distinct groups of blastholes. Only three blastholes are indicated in each group shown in FIG. 2, although it will be apparent that any one group may comprise any number of blastholes. In the embodiment shown there are nine groups of blastholes.

Figure 2:
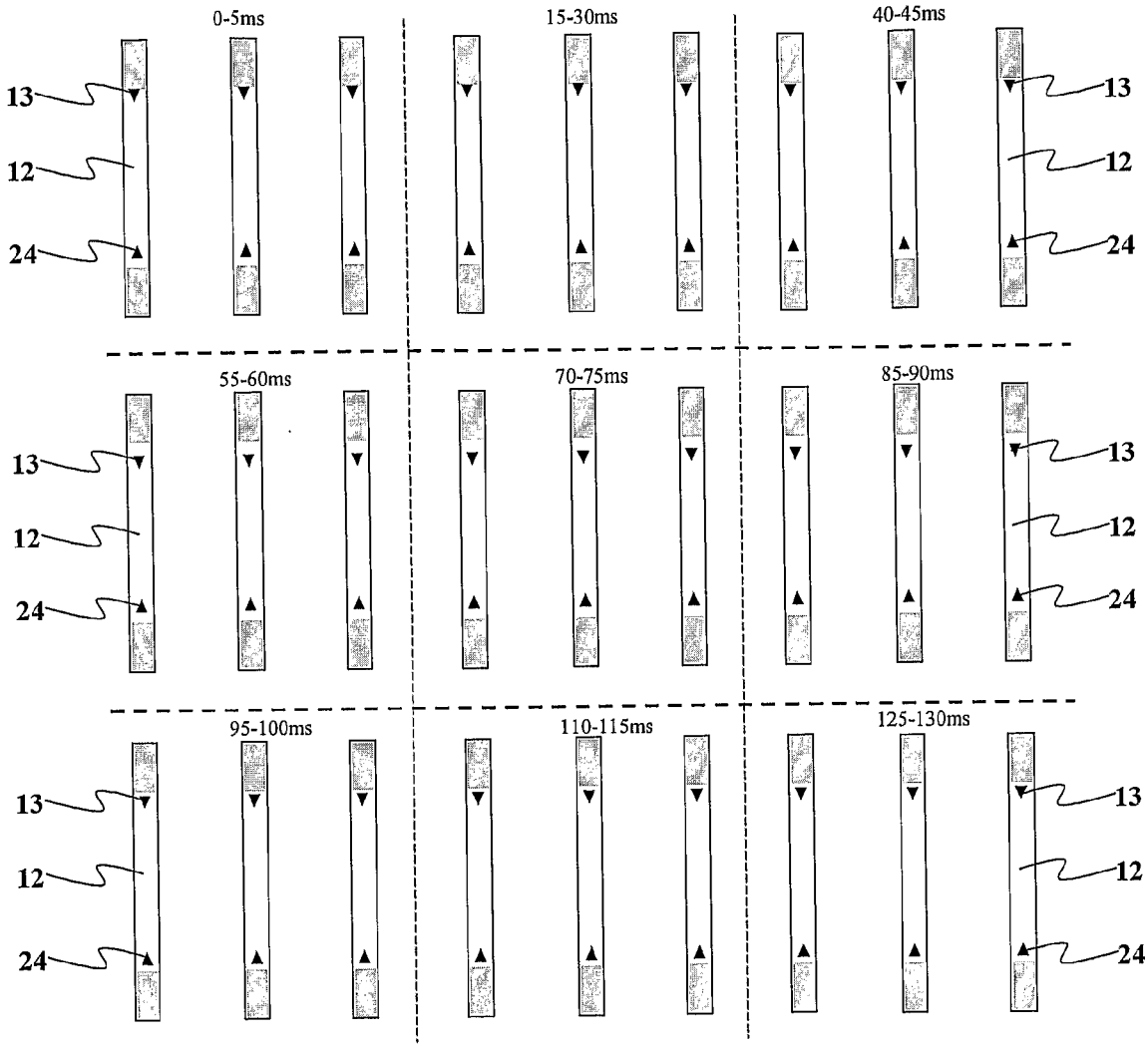
FIG. 2 schematically illustrates a blasting arrangement comprising a plurality of blastholes arranged into groups, each with an associated column of explosive material.

FIG. 2 also illustrates the timing for actuation of the columns of explosive material 12 in each blasthole 10 from time zero (0 ms). The explosive charges in each group of blastholes are initiated within 5 ms of one another, and a delay of at least 8 ms (e.g. 10 ms) occurs between actuation of different adjacent groups. This configuration permits interference to occur between stressfields from adjacent blastholes 10, thereby to enhance fragmentation and fracture of the rock between the blastholes. The delay of more than 8 ms between actuation of explosive charges between blastholes 10 reduces the environmental stress of excessive ground vibrations. Typically, a delay of 8 ms or more can allow stressfields from nearby blastholes 10 of adjacent groups of blastholes 10 to substantially dissipate before actuation of explosive charges in any given group. Therefore, the embodiment of the invention illustrated in FIG. 2 presents significant advantages with regard to reducing environmental stress and excessive ground vibrations.

In FIG. 2, the explosive charges 12 in each group of blastholes are shown to actuate within 5 ms of one another. However, the invention is not limited in this regard. Similar advantages can be achieved by initiating the explosive charges 12 within any group of blastholes in a "domino"-like fashion, wherein the explosive charges in most if not all adjacent blastholes are actuated within 5 ms of one another. For example, if the blastholes are arranged in a row of blastholes then an explosive charge in a blasthole at one end of the row may be actuated at time zero, the explosive charge in the next blasthole in the row may be actuated at time zero plus 4 ms, the explosive charge in the next blasthole in the row may be actuated at time zero plus 8 ms, and so on until all explosive charges in all of the blastholes of the group have been actuated. In this way, explosive charges with any given group may actuate more than 5 ms apart, but explosive charges in adjacent blastholes will generally be actuated less than 5 ms apart.

It should also be emphasised that the timing discussed above relates to particularly preferred embodiments of the invention and is not intended to be limiting in any way. Typically, in preferred embodiments explosive charges in adjacent blastholes are actuated within 5 ms of one another to help ensure interference between stressfields from the blastholes. However, a delay time of more than 5 ms may be appropriate under some circumstances. For example, with specific types of rock it may be preferred to actuate explosive charges in adjacent blastholes more than 5 ms apart, and still achieve desirable results of rock fragmentation resulting from shockwave interference.

In addition, the proposed delay of at least 8 ms between actuation of explosive charges in different groups of blastholes is also preferred. Under specific environmental conditions (including the nature, strata, and density of the rock) the stressfields from any specific group of blastholes may take longer than 8 ms to substantially dissipate. In this scenario it may be preferable to increase the delay between adjacent groups to 10-20 ms or greater. On the other hand, if environmental conditions allow for rapid dissipation of shockwaves from the blast site then the delay between adjacent groups could be reduced to less than 8 ms.

Any initiation pattern may be used to actuate the explosive charges within any group of blastholes. Particularly preferred detonation patterns are discussed with reference to FIGS. 3 and 4. It should be noted that the methods of blasting in accordance with selected embodiments of the present invention may involve only a single group of blastholes, wherein most if not all of the explosive charges within most (if not all) adjacent blastholes of the group are actuated within 5 ms of one another in accordance with a preferred actuation pattern as outlined in FIGS. 3 and 4. For simplicity, only a single ordered row is illustrated in each embodiment shown in FIGS. 3 and 4. However, the invention encompasses the use of groups of blastholes arranged in two or three dimensions in a section of rock.

Figure 3A:
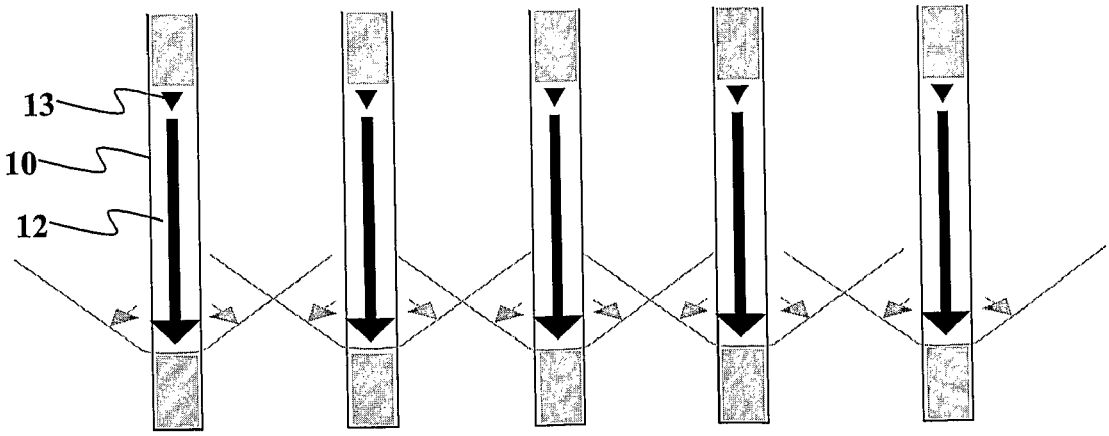
FIG. 3*a* schematically illustrates a preferred method of blasting, involving unidirectional actuation of each column of explosive material in blastholes arranged in a group.
Figure 3B:
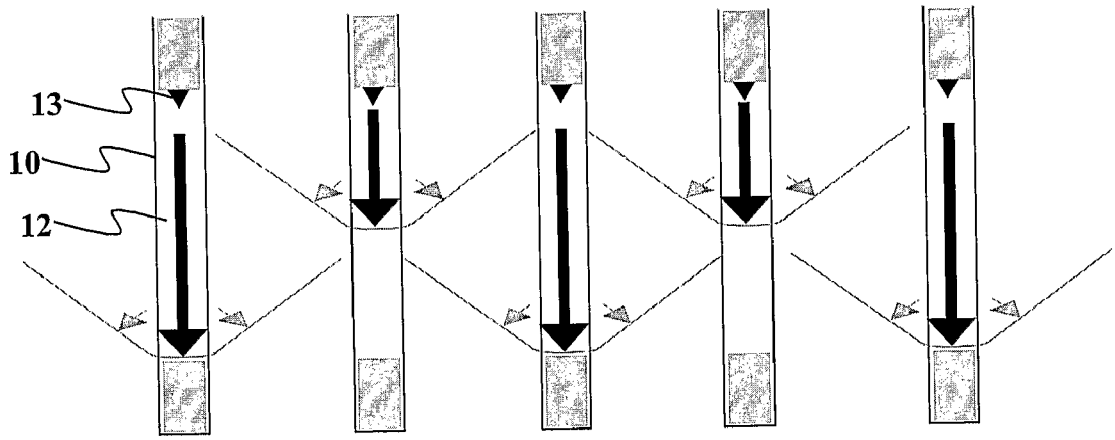
FIG. 3*b* schematically illustrates a preferred method of blasting, involving unidirectional actuation of each column of explosive material in blastholes arranged in a group.
Figure 3C:
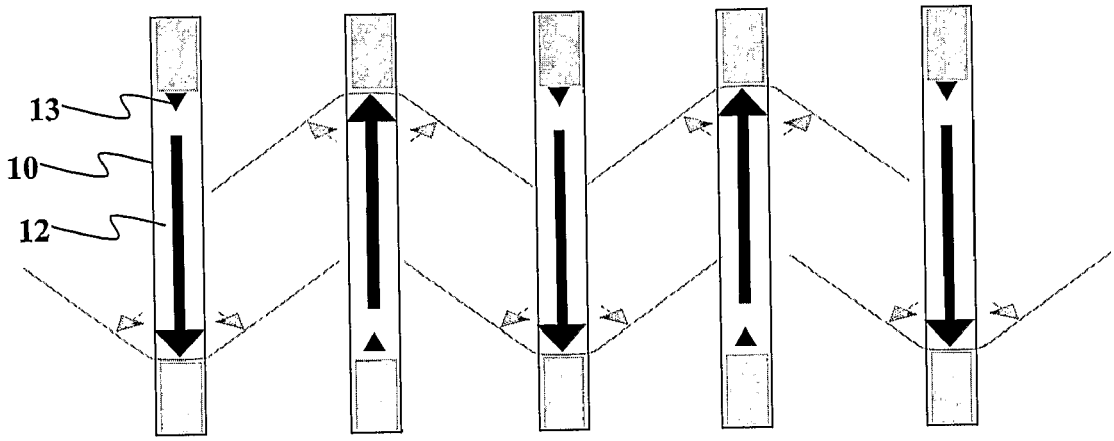
FIG. 3*c* schematically illustrates a preferred method of blasting, involving unidirectional actuation of each column of explosive material in blastholes arranged in a group.

Turning first to FIGS. 3*a*, 3*b*, and 3*c*, each of the embodiments illustrated relates to a single group of blastholes 10, each blasthole comprising a column of explosive material 12, wherein a single initiation means 13 is associated at one end of each column for unidirectional actuation of each column. In this way, a single conical radiation of stressfields is generally propagated from each blasthole 10 as each detonation head progresses along each column. In FIG. 3*a*, each initiation means 13 is located on the same end of each column 12, and each initiation means 13 initiates actuation of each associated column 12 at substantially the same time. In this way, the resulting stressfields are similar between the columns 12, and interfere or overlap in a predictable fashion between the columns 12. In contrast, FIG. 3*b* illustrates an alternative method of blasting, wherein all of the initiation means 13 are located on the same end of each column 12 (in a similar manner to FIG. 3*a*). However, in contrast to the embodiment shown in FIG. 3*a*, the embodiment in FIG. 3*b* includes initiation means 13 that in adjacent blastholes induce actuation of each associated column 12 at a different time. As a result, the progression of the detonation heads in adjacent blastholes 10, and the radiation of stressfields, is staggered. FIG. 3*c* illustrates yet another embodiment of the invention, wherein the initiation means 13 in adjacent blastholes 10 are located on opposite ends of each column 12. As a result, each detonation head moves along each column of explosive material 12 in an opposite direction to detonation heads in adjacent blastholes 10, thereby causing generally opposing stressfields that interfere in those regions of rock in between the blastholes.

Particularly preferred embodiments of the invention are illustrated in FIG. 4. Each of these embodiments involves the use of blastholes 10 each comprising a column of explosive material 12 that can be actuated via initiation devices 13, 24 provided at both ends of the column 12. In this way, two detonation heads are generated in each column of explosive material 12, thereby resulting in two conical radiations of stressfields from each blasthole 10. Typically, but not necessarily, each conical radiation may interfere both with stressfields from another conical radiation generated in the same blasthole 10, and with other conical radiations of stressfields from adjacent blastholes 10.

Figure 4A:
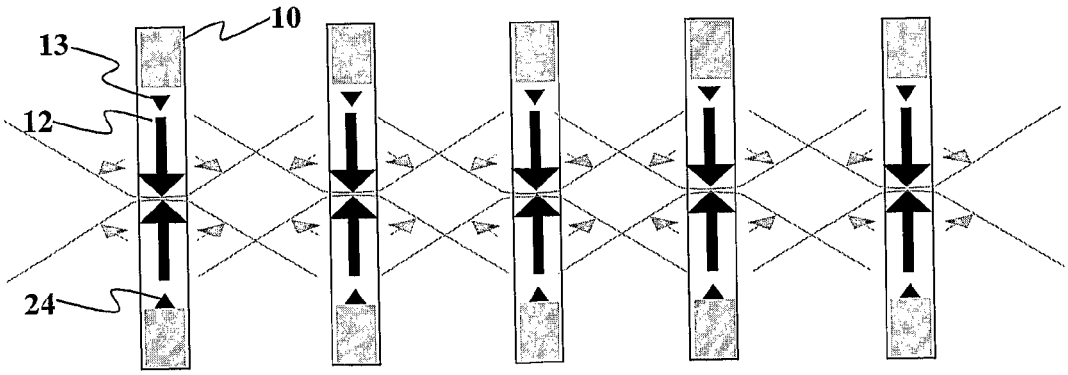
FIG. 4*a* schematically illustrates a preferred method of blasting, involving bidirectional actuation of each column of explosive material in blastholes arranged in a group.
Figure 4B:
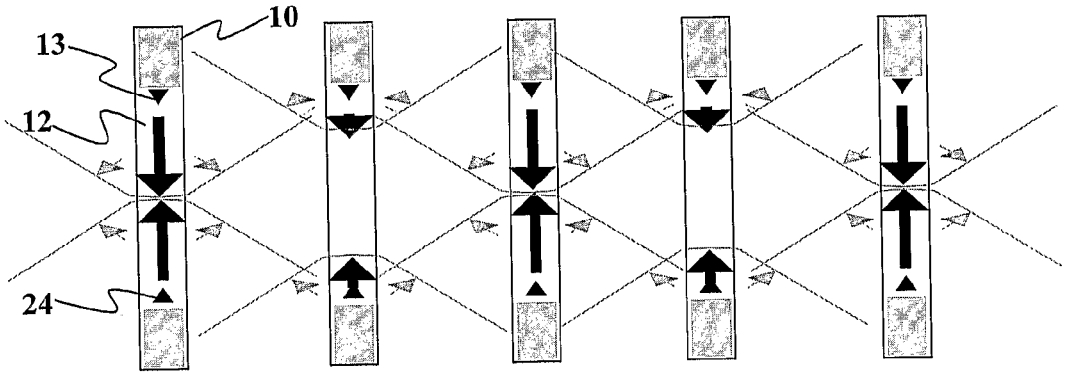
FIG. 4*b* schematically illustrates a preferred method of blasting, involving bidirectional actuation of each column of explosive material in blastholes arranged in a group.

The embodiment illustrated in FIG. 4*a* includes a series of blastholes 10, wherein each associated column of explosive material 12 is actuated by initiation devices 13, 24 at both ends at the same time. As a result, two detonation heads are generated in each column 12, which converge in a central portion of each column at substantially the same time. The resulting stressfields from each column 12 interfere in each region between adjacent blastholes 10 thereby enhancing rock fragmentation and fracture. The alternative embodiment illustrated in FIG. 4*b* is similar to that shown in FIG. 4*a*, except that the initiation means 13, 24 in every other blasthole 10 actuates an associated column of explosive material 12 at a time later (for example 1-5 ms) after initiation of the explosive charges in a first set of blastholes 10. Another way to consider the blastholes 10 illustrates in FIG. 4*b* is to consider the first, third, and fifth blastholes (counting from the left) as comprising a first array of blastholes that fire first, whereas the second and fourth blastholes (counting from the left) constitute a second array of blastholes that fire after a short delay. As a result, the progression of the detonation heads and the stressfields from the actuation of the columns of explosive material in the second array of blastholes is delayed in comparison to the first array of blastholes, resulting in an alternative pattern of stressfield interference between the blastholes, with corresponding advantages in rock fragmentation and fracture.

In the embodiment illustrated in FIG. 4*b*, it is important to note that although a delay occurs between actuation of explosive charges in blastholes 10 of different arrays, the initiation devices 13, 24 associated with each blasthole 10 cause actuation of both ends of the associated column of explosive material 12 at substantially the same time. This contrasts to the embodiment of the invention illustrated in FIG. 4*c*, which pertains to a particularly preferred embodiment giving significant advantages of efficient blasting. In this embodiment, each initiation device 13, 24 in each blasthole 10 has a distinct delay time for actuation of an associated column of explosive material 12. The timing of actuation events is such that the resultant convergence zones in each column of explosive material 12 are staggered. The corresponding radiations of stressfields are also staggered between adjacent blastholes 10 in such a manner that the stresses induced in different portions of rock between different blastholes give rise to excellent rock fragmentation and fracture.

Figure 4C:
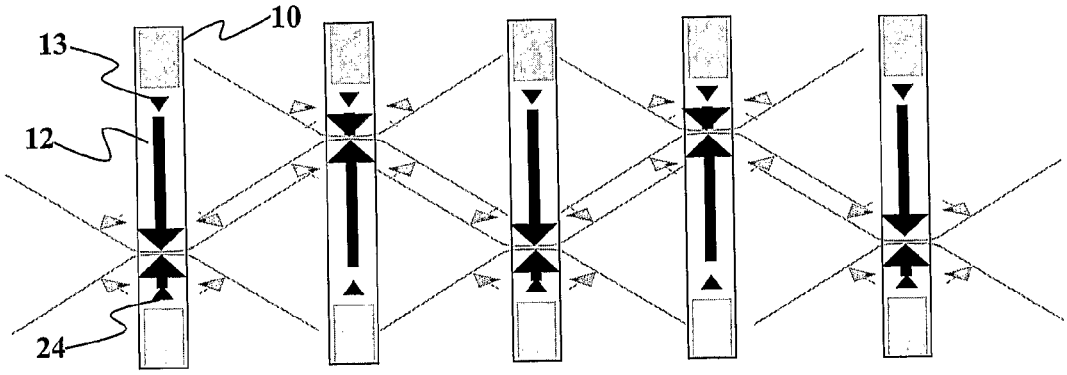
FIG. 4*c* schematically illustrates a preferred method of blasting, involving bidirectional actuation of each column of explosive material in blastholes arranged in a group.

When blastholes in adjacent arrays are arranged to fire bi-directionally so that the detonation convergence zones of adjacent holes are staggered, as is the case in FIG. 4*c*, it is apparent that the principal directions of detonation of the adjacent holes alternate. The principal direction of detonation for a blasthole may be defined as the direction in which most (i.e. between 51% and 95% of the explosive column length) of explosive column detonates before converging on the opposing detonation front.

It is to be understood that though the invention is not restricted to the use of any one of the initiation patterns described herein across the entire blast field. Indeed, it may be advantageous to use combinations of the various initiation patterns described across the blast field in order to achieve either various fragmentation outcomes, or similar fragmentation outcomes within various rock regimes, or to achieve vibration and damage control as these requirements may vary across the blast field. For example, any combination of the initiation patterns described in FIGS. 3 and 4 may be applied selectively across a single blast field according to varying requirements.

It has also been found that the use of the particular group initiation patterns described herein in combination with conventional initiation patterns in particular parts of the blast field can provide additional useful control. For example, the particular group initiation patterns described herein may be used in the more central parts of a blast field to achieve enhanced rock fragmentation while conventional blasthole initiation techniques may be used at the perimeter regions of the blast in order to reduce rock damage to the adjacent host rock. This is particularly useful when limited damage to the adjacent rock is required, for example where it is defined to form a stable highwall. In this context conventional initiation techniques imply any blasthole initiation means and timing arrangement known in the art. Generally, this would involve single point initiation in each hole with delays in excess of 8 ms between any adjacent holes.

Figure 5:
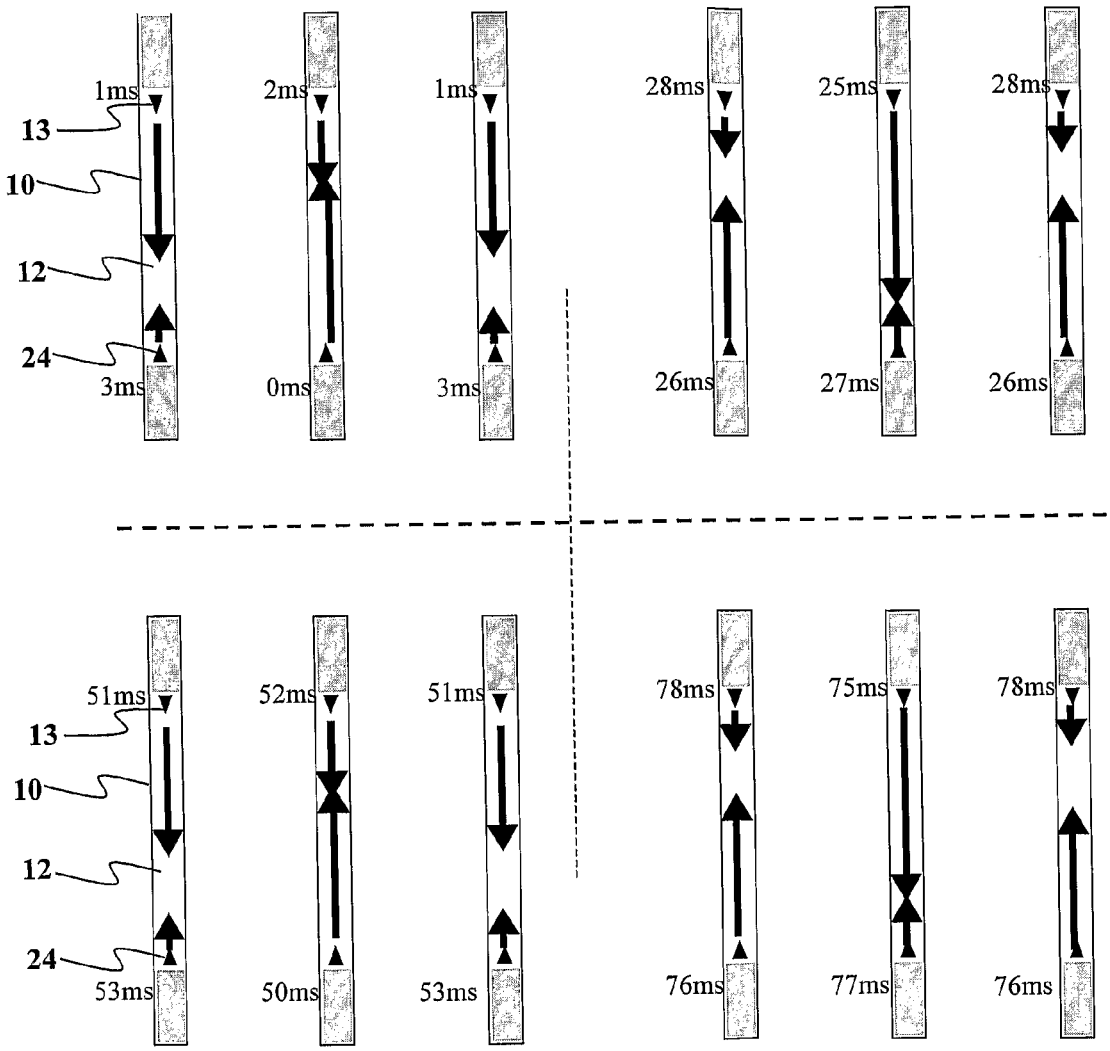
FIG. 5 schematically illustrates a most preferred embodiment of the invention, involving a method of blasting involving a plurality of blastholes arranged into groups.

The teachings of the invention in relation to FIG. 4*c* form part of the embodiment illustrated in FIG. 5, which represents a most preferred embodiment of the invention. In this embodiment, four groups of blastholes 10 are schematically illustrated, each as a row of three blastholes 10, each group separated by broken lines. The times indicated (in ms) illustrate the time following time zero from which the initiation devices 13, 24 at each end of each column of explosive material 12 were triggered to actuate a corresponding end of an associated column. The large arrows indicate the direction of movement of the detonation heads, and the convergence of each pair of large arrows for each corresponding column 12 indicates the convergence zone for the column 12. It will be noted that for each group, the timing of actuation of each end of each column 12 is such that the convergence zones of each adjacent column are staggered in accordance with the embodiment illustrated in FIG. 4*c*. In this way, the shear forces that cause fragmentation and fracture of rock between the blastholes 10 are optimised as previously discussed. Moreover, a delay of more than 8 ms occurs between the completion of actuation of the explosive charges in one group, before commencement of actuation of explosive charges in an adjacent group. In this way, environmental stresses such as ground vibrations, and safety at the blast site are maintained.

The present invention also provides corresponding blasting systems for conducting any of the methods of the invention. Typically, such blasting systems may comprise a plurality of explosive charges, each charge positioned in a corresponding blasthole; initiation means associated with each explosive charge for actuation thereof in response to appropriate signals; timing means to time actuation of each explosive charge in accordance with the requirements of the method; and at least one blasting machine to provide control signals to each initiation means in the system. Preferably, each initiation means and timing means relates to the use of an electronic detonator. Such detonators, at least in preferred embodiments, enable precision timing of explosive charge actuation.

EXAMPLES

Example 1

Figure 6:
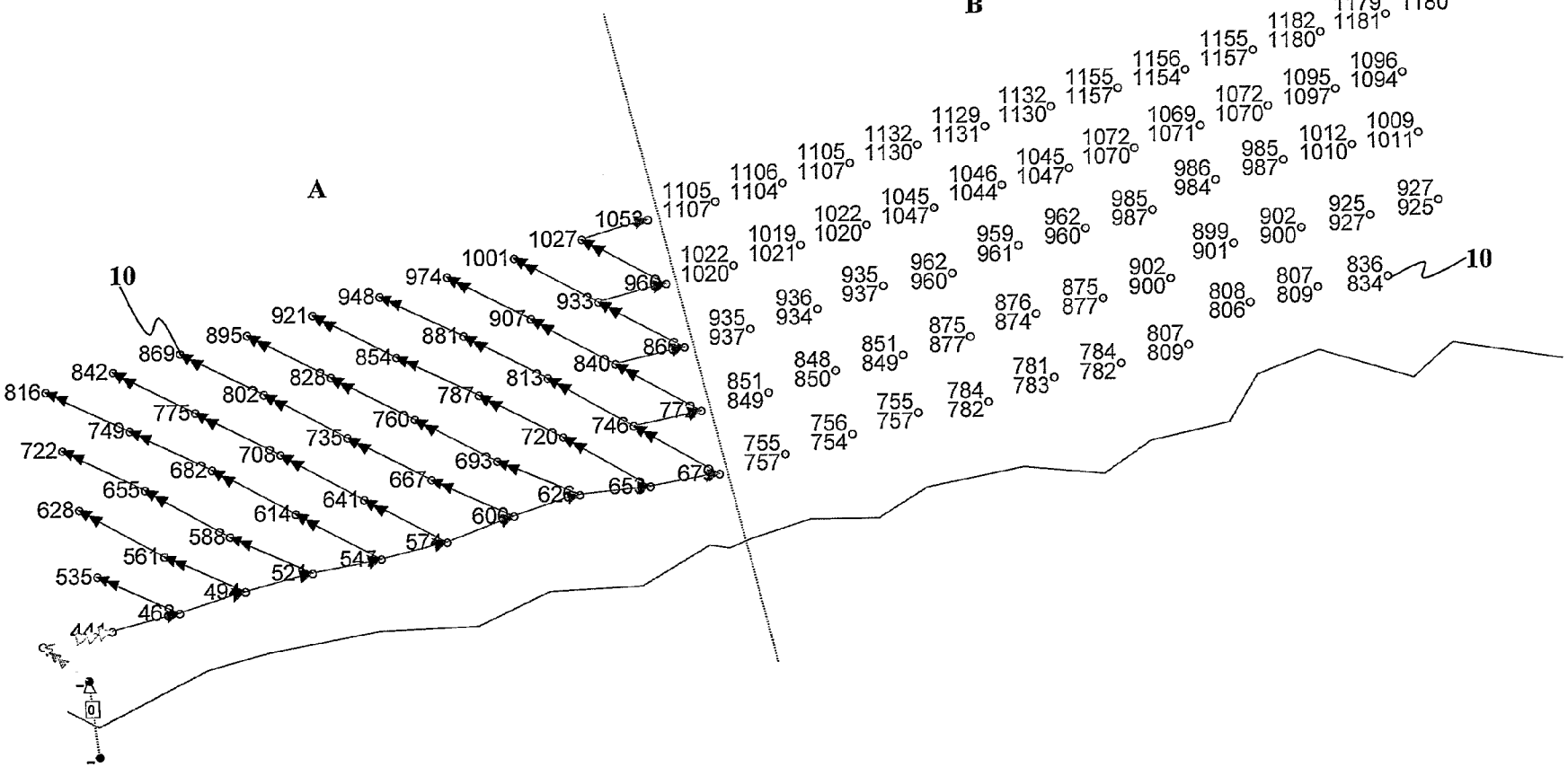
FIG. 6 schematically illustrates blast designs referred to in Example 1 below.

Examples from two blasts fired in a hard rock quarry in Australia are presented here to demonstrate both the method of the invention and the results obtained. FIG. 6 illustrates one of the blasts, and shows that each blast was divided into two parts A, B, with one part A being initiated in a conventional manner using standard non-electric delay detonators and the other part B using electronic delay detonators arranged and initiated in accordance with the embodiment of the invention shown in FIG. 5. All other design features of both parts of the blasts were kept the same, for example blasthole pattern, explosive loading and powder factor. The conventional parts of the blasts used 25 ms delays between adjacent holes in each row and 65 ms delays between rows set on the echelon in the normal way. This is a typical conventional delay arrangement for blasts of the dimensions employed. The delay times (ms) for each blasthole in this part of the blast are included in FIG. 6.

The electronic parts of the blasts were initiated in groups of three holes with two arrays in each group using the principles of FIG. 5. Groups were separated by nominal time delays of 25 ms to provide vibration control in accordance with the present invention. Holes were grouped and provided with alternating patterns of initiation, as see FIG. 5, both within and between rows. For this part of the blast two detonator delay time (ms) appear adjacent each blasthole in FIG. 6. For any given blasthole in the pair of numbers given in FIG. 6, the upper number represents the delay time for the upper detonator in the blasthole and the lower number represents the delay time for the lower detonator in the blasthole. For example, in FIG. 6 the blasthole assigned the delay times 755, 757 has a detonator positioned are the top of the explosives column set to a delay time of 755 ms and a detonator at the bottom of the explosives column set to a delay time of 757 ms.

Figure 7:
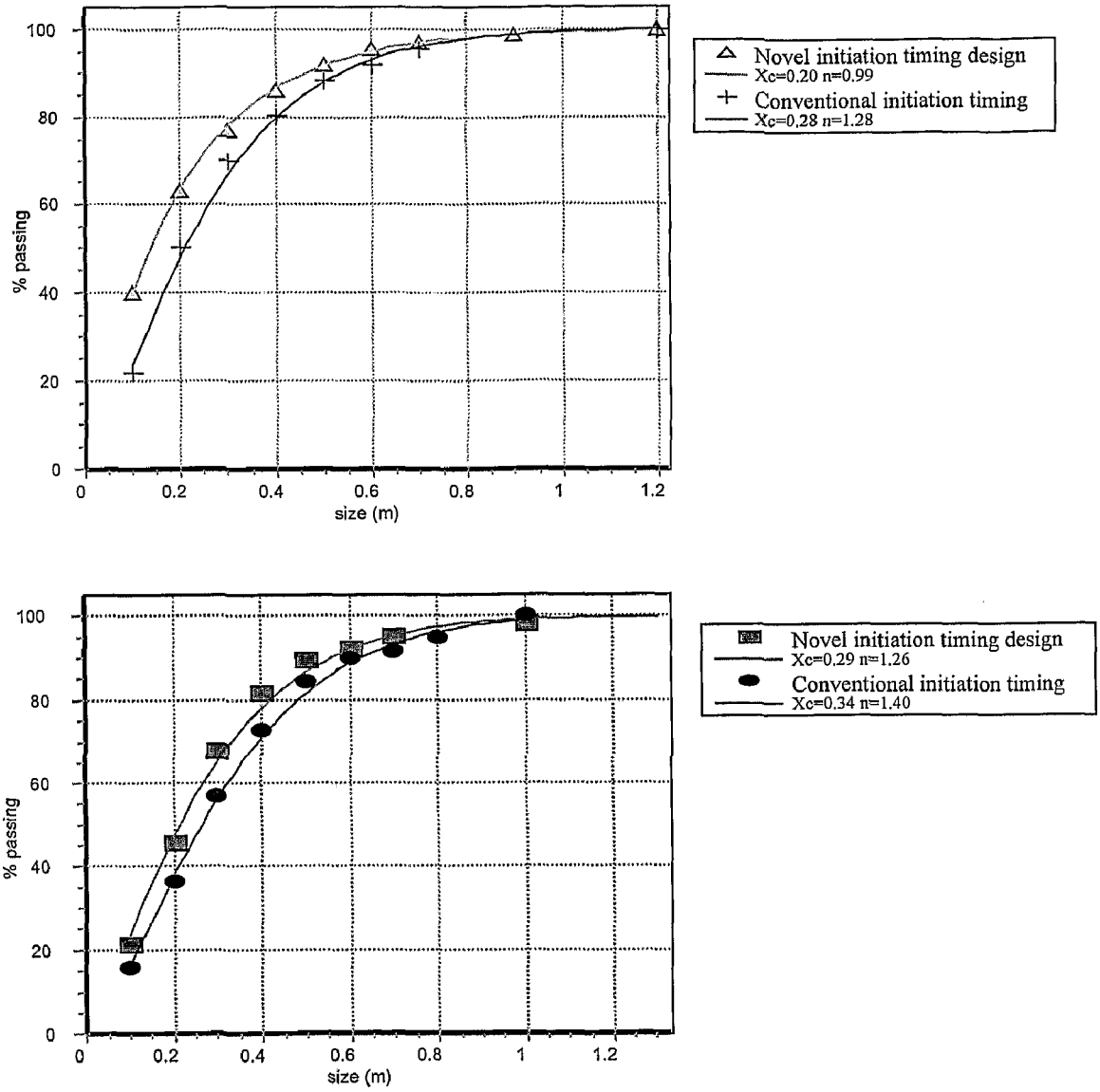
FIGS. 7 and 8 are graphs showing experimental results obtained in Example 1 below.
Figure 8:
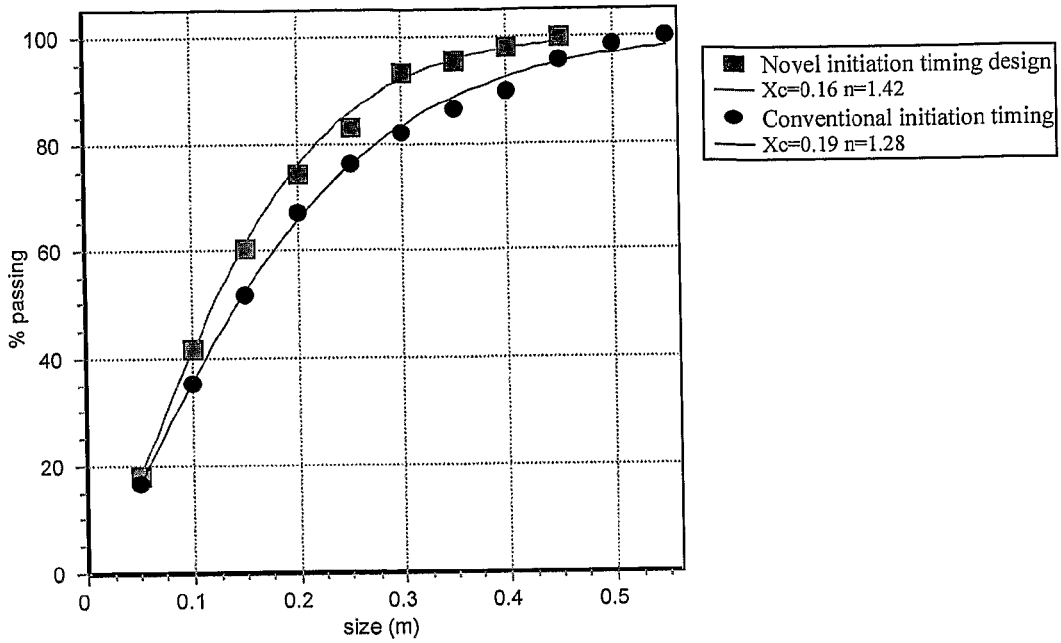

Each part of the blasts was carefully excavated, with fragmentation measurements using digital image analysis being undertaken on both parts of each blast. The results of the fragmentation analyses using the Powersieve program (Noy, M. 1997, 2D versus 3D fragmentation analysis: preliminary findings, *Proc.* 13$^{th}$ *Ann. Symp. Expl. & Blasting Research*, pp 181-190. Cleveland: Int. Soc. Expl. Eng. (ISEE)) are shown in FIG. 7. These results show a clear reduction in overall fragment sizes for the sampled surfaces of the rockpiles for the part of the blast using the invention B as compared to the part of the blast using the conventional initiation method A. Similar reductions have been measured in more extensive samples of the processed rock at the crusher, as shown in FIG. 8 for one of the example blasts which was measured in this way using an automated camera permanently installed over the crusher feed.

Example 2

Figure 9:
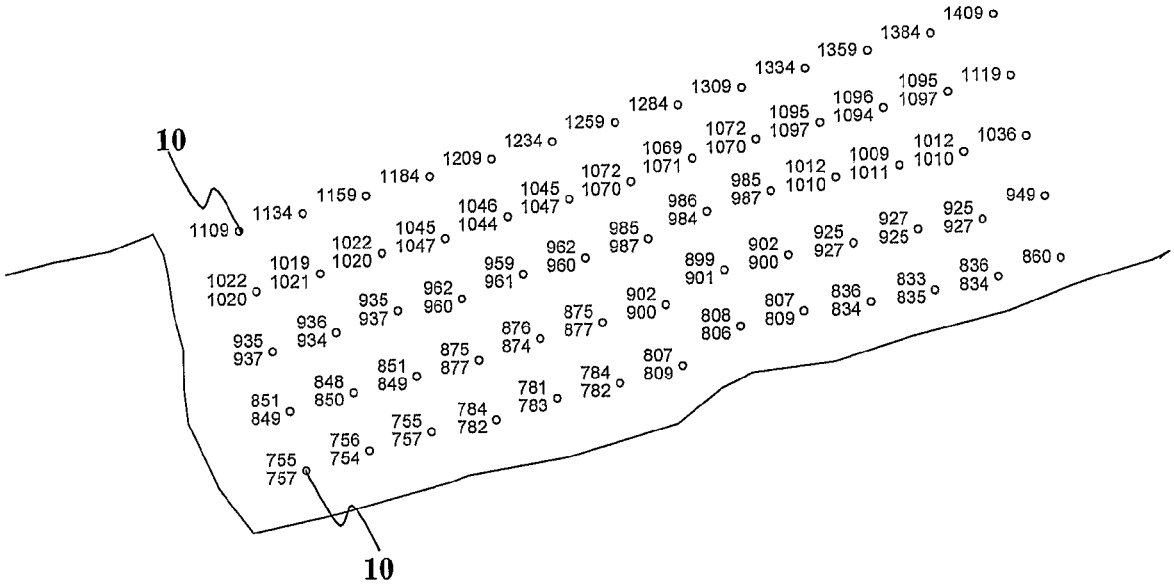
FIGS. 9 and 10 schematically illustrate blast designs referred to in Examples 2 and 3 below, respectively.

Following the increased evidence of localised rock damage and cracking associated with part B of the blast in Example 1, a blast was designed to initiate using the invention described herein over substantially an entire blast field with conventional methodology and delays being used along the back and side perimeters of the blast field to reduce rock damage in the new highwalls. The design is illustrated in FIG. 9. In this Figure pairs of number adjacent a given blasthole 10 detonate upper and low initiation device delay times as described above. A single number represents a delay time of blastholes employing conventional technology.

Example 3

Figure 10:
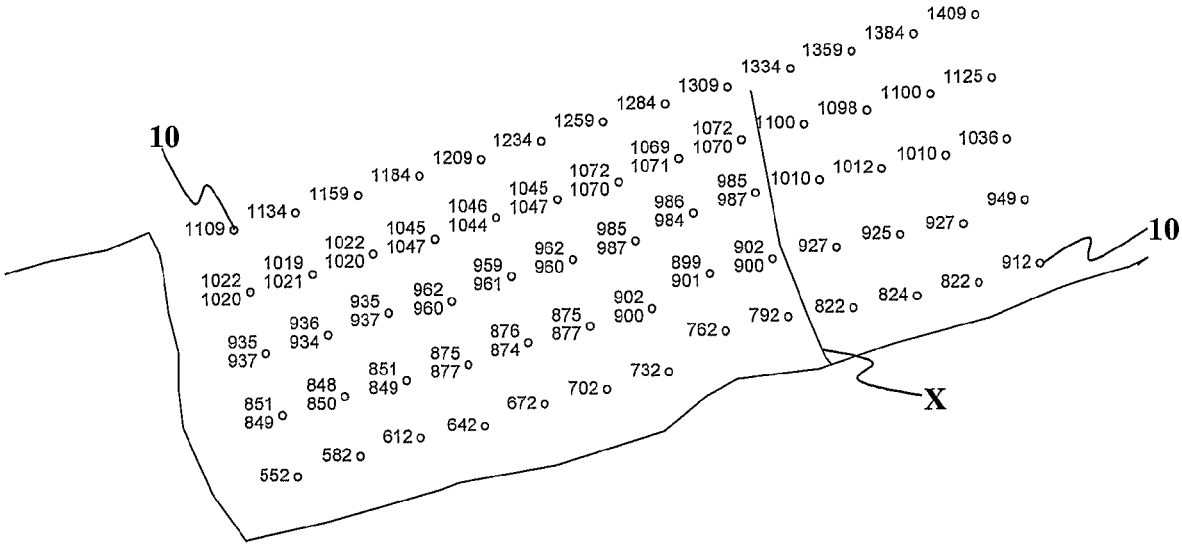

In another example, a blast was designed to initiate using various aspects of the invention described herein in combination to provide different effects in different zones of the blast. In this example, conventional delays are used along the back perimeter to reduce rock damage in newly exposed highwall as well as in the front row to reduce risks of airblast and environmental disturbance. Holes initiated only at the top, but in staggered arrays as in FIG. 3*b*, are employed in the central three rows on the far right side of the blast while holes using dual initiation from both the top and bottom of the holes, again in staggered arrays, as in FIG. 4*b* are used in the central three rows in the remainder of the blast. The choice of the initiation patterns in the central rows is dictated by the rock strengths in the respective zones of the blast and to a lesser extent the need to save costs by reducing the number of initiators used in the blast. In FIG. 10 the line X represents a line of demarcation between different rock types in the blast field. The design is shown in FIG. 10 using similar nomenclature and reference numerals as used above.

While the invention has been described with reference to particular preferred embodiments thereof, it will be apparent to those skilled in the art upon a reading and understanding of the foregoing that numerous methods for blasting rock, other than the specific embodiments illustrated are attainable, which nonetheless lie within the spirit and scope of the present invention. It is intended to include all such methods, systems, and equivalents thereof within the scope of the appended claims.

The invention claimed is:

1. A method of blasting rock in a blastfield to cause fragmentation of the rock without excessive ground vibrations, the method comprising the steps of:

providing two or more rows of blastholes in the rock, wherein the blastholes in at least one of said rows is arranged in two or more groups, each group comprising from 2 to 7 blastholes each of which is adjacent to another of said blastholes within the group;

loading each blasthole with an explosive charge;

providing blast initiation means associated with each explosive charge; and inducing timed actuation of each explosive charge via the associated blast initiation means to propagate stressfields from each blasthole;

wherein the explosive charges in adjacent blastholes within each group of blastholes are actuated within 5 ms of one another, whereby the stressfields from the blastholes within each group combine prior to dissipation to enhance fragmentation of the rock, and wherein for each of said groups of blastholes a delay of at least 8 ms occurs between completion of actuation of explosive charges in the group and commencement of actuation of explosive charges in all others of said groups of blastholes, whereby the combined stressfields that propagate from blastholes within any group of blastholes at least substantially dissipate prior to actuation of explosive charges within blastholes of the other groups of blastholes.

2. A method according to claim 1, wherein each group comprises from 3 to 5 blastholes.

3. A method according to claim 1, wherein each group comprises 3 blastholes.

4. A method according to claim 1, wherein the explosive charges in adjacent blastholes within any group of blastholes are actuated at different times within 5 ms of one another.

5. A method according to claim 4, wherein the explosive charges in adjacent blastholes within any group of blastholes are actuated within about 1 to 3 ms of one another.

6. A method according to claim 1, wherein the explosive charges in all blastholes within any group of blastholes are actuated within 5 ms of one another.

7. A method according to claim 6, wherein the explosive charges in all blastholes within any group of blastholes are actuated at different times within 5 ms of one another.

8. A method according to claim 6, wherein the explosive charges in all blastholes within any group of blastholes are actuated within about 1 to 3 ms of one another.

9. A method according to claim 1, wherein each blasthole in at least one group of the two or more groups of blastholes is loaded with an explosive charge that comprises a column of explosive material and that is associated with an initiation means comprising a single initiation device positioned in the column to produce a detonation head within the column such that the detonation head burns away from the initiation device, thereby to propagate the stressfields from the column.

10. A method according to claim 9, wherein the at least one group of blastholes comprises two or more arrays of one or more blastholes, the explosive material in different arrays within the same group being actuated at different times but the explosive material in two or more blastholes of any selected array being actuated at substantially the same time, and wherein each blasthole from any selected array is adjacent to a blasthole of another array in the group.

11. A method according to claim 10, wherein the initiation devices are positioned at or adjacent the same end of the columns of explosive material in any selected group, thereby to stagger progression of the detonation heads within at least two adjacent blastholes of the at least one group of blastholes.

12. A method according to claim 11, wherein the initiation devices are positioned at or adjacent the toe end of the columns of explosive material in the at least one group of blastholes.

13. A method according to claim 9, wherein the at least one group of blastholes comprises two or more arrays of one or more blastholes, in at least one of the arrays the initiation device being positioned at a first end of each column for unidirectional actuation of each column in the at least one array in a first direction and in at least one other of the arrays the initiation device being located at a second end of each column in the at least one other array for unidirectional actuation thereof in a second direction opposite to said first direction, and wherein each blasthole from any selected array is adjacent to a blasthole of any other array of the group.

14. A method according to claim 9, wherein the initiation device in each column of the at least one group of blastholes is positioned remote from the ends of the column.

15. A method according to claim 14, wherein the initiation devices in adjacent columns of the at least one group of blastholes are offset relative to each other.

16. A method according to claim 1, wherein each blasthole in at least one group of the two or more groups of blastholes is loaded with an explosive charge that comprises a column of explosive material and that is associated with an initiation means comprising a first and a second initiation device positioned at or adjacent opposite ends of the column to produce two detonation heads within the column such that the detonation heads burn away from each initiation device towards each other, thereby to propagate opposed stressfields from the column in the at least one group of blastholes that combine both with one another and with stressfields propagating from at least one adjacent blasthole in said group to enhance said fragmentation of the rock.

17. A method according to claim 16, wherein the at least one group of blastholes comprises two or more arrays of one or more blastholes, the columns of explosive material in blastholes of different arrays within the same group being actuated by the first initiation devices at different times and by the second initiation devices at different times but the columns of explosive material in two or more blastholes of any selected array being actuated by the first initiation devices thereof at substantially the same time and by the second initiation devices thereof at substantially the same time, and wherein each blasthole from any selected array is adjacent to a blasthole in any other array in the group thereby to stagger progressive bidirectional actuation of said columns of explosive material in the blastholes within the at least one group of blastholes.

18. A method according to claim 17, wherein the column of explosive material in the blasthole or each blasthole of any selected array within the at least one group of blastholes is actuated by the first and second initiating devices at substantially the same time.

19. A method according to claim 17, wherein the column of explosive material in the blasthole or each blasthole of any selected array within the at least one group of blastholes is actuated by the first and second initiating devices at different times.

20. A method according to claim 19, wherein the column of explosive material in the blasthole or each blasthole within the array is actuated by the second initiation device at a time when the detonation head from the actuation of the column by the first initiation device has travelled between about 51 and 95% of the length of the column towards the second initiation device.

21. A method according to claim 19, wherein the column of explosive material in the blasthole or each blasthole within the array is actuated by the second initiation device at a time when the detonation head from the actuation of the column by the first initiation device has travelled between about 75 and 85% of the length of the column towards the second initiation device.

22. A method according to claim 16, wherein the columns of explosive material in all of the blastholes within the at least one group of blastholes are actuated by the first initiation devices at different times to each other and by the second initiation devices at different times to each other.

23. A method according to claim 22, wherein each column of explosive material is actuated by the first initiation device at substantially the same time as it is actuated by the second initiation device.

24. A method according to claim 22, wherein each column of explosive material is actuated by the first and second initiation devices at different times.

25. A method according to claim 24, wherein the column of explosive material in each blasthole within the at least one group of blastholes is actuated by the second initiation device at a time when the detonation head from the actuation of the column by the first initiation device has travelled between about 51 and 95% of the length of the column towards the second initiation device.

26. A method according to claim 24, wherein the column of explosive material in each blasthole within the at least one group of blastholes is actuated by the second initiation device at a time when the detonation head from the actuation of the column by the first initiation device has travelled between about 75 and 85% of the length of the column towards the second initiation device.

27. A method according to claim 1, wherein each blasthole in at least one group of the two or more groups of blastholes is loaded with an explosive charge that comprises a column of explosive material and the at least one group of blastholes comprises two or more arrays of one or more blastholes, wherein in at least one of the arrays the initiation means comprises a first and a second initiation device positioned at or adjacent opposite ends of each column of the array to produce two detonation heads within the column such that the detonation heads burn away from each initiation device towards each other, thereby to propagate opposed stressfields from the column that combine with one another, wherein in at least one other of the arrays the initiation means comprises a single initiation device positioned remote from the opposite ends of each column of the array to produce a single detonation head within the column that burns in opposite directions away from the initiation device, and wherein each blasthole from any selected array is adjacent to a blasthole in any other array in the at least one group of blastholes thereby to propagate stressfields from adjacent blastholes within the at least one group of blastholes that combine to enhance fracture.

28. A method according to claim 27, wherein the single detonation device in each column of said at least one other array is disposed about midway along the column.

29. A method according to claim 27, wherein the explosive material in each column of said at least one array is actuated by the first and second initiation devices at substantially the same time.

30. A method according to claim 1, wherein the initiation means comprises electronic detonators.

31. A method according to claim 1, wherein the blastholes in each of at least two of the rows are arranged in two or more of said groups.

32. A method according to claim 31, wherein all of the blastholes in the blastfield are arranged in said groups.

33. A method according to claim 1, wherein the blastfield is arranged in blast sections and the blastholes in at least one of the sections are arranged in said groups.

* * * * *